United States Patent [19]

Kusenda

[11] 4,290,250

[45] Sep. 22, 1981

[54] METHOD AND APPARATUS FOR INSULATING BUILDINGS

[75] Inventor: Stephen R. Kusenda, Knoxville, Tenn.

[73] Assignee: Insulation Materials, Inc., Knoxville, Tenn.

[21] Appl. No.: 98,181

[22] Filed: Nov. 28, 1979

[51] Int. Cl.[3] ..... E04B 1/74

[52] U.S. Cl. ..... 52/404; 52/506; 52/741

[58] Field of Search ..... 52/506, 512, 404, 410, 52/461, 765, 86, 407, 741; 24/217; 85/36, 7

[56] References Cited

U.S. PATENT DOCUMENTS

| | | | |
|---|---|---|---|
| 3,174,591 | 3/1965 | Waile | 52/410 |
| 3,238,835 | 3/1966 | Rosenberg | 52/407 X |
| 3,307,306 | 3/1967 | Oliver | 52/409 X |
| 3,523,395 | 8/1970 | Rutter et al. | 52/506 X |
| 3,738,217 | 6/1973 | Walker | 52/506 X |
| 4,003,175 | 1/1977 | Patry | 52/506 |
| 4,070,841 | 1/1978 | La Haye et al. | 52/506 |
| 4,174,596 | 11/1979 | Deibele | 52/404X |
| 4,244,269 | 1/1981 | Gorell | 52/506 X |

*Primary Examiner*—Carl D. Friedman

*Attorney, Agent, or Firm*—Luedeka & Fitch

[57] ABSTRACT

A method and apparatus for applying a layer of flexible insulative material to the interior surface of a wall from which a plurality of shaft members extend inwardly. A flexible insulating material is applied to the interior surface and a plurality of the shaft members are directed through the insulating material. An elongated flexible fastener member engages a plurality of the shaft members to secure the insulative layer to the wall.

9 Claims, 3 Drawing Figures

METHOD AND APPARATUS FOR INSULATING BUILDINGS

The present invention relates to insulation systems and more particularly to an insulation system for arched-wall buildings.

The insulation properties of a building are important, particularly when the inhabitants and/or contents must be protected from the ambient temperature, either by heating or cooling. However, there are some buildings for which conventional insulation systems are not suitable. A primary example of such buildings is a corrugated metal arch building, often known as a Quonset hut. Metal arch buildings are quickly constructed from relatively inexpensive materials, e.g., corrugated metal panels and bolts. These buildings are often used for storage and for housing manufacturing facilities. The armed forces have used such buildings to house personnel.

In its simplest form, a metal arch building comprises a plurality of curved panels which are disposed side-by-side, with their adjacent side edges overlapping and bolted together along such overlapping edges, to define a hemicylindrical structure. Planar end walls, which include doors and/or windows are attached to the structure at both ends to enclose the building. Each of the two end walls also comprises a plurality of interconnected panels which are bolted together to form a continuous planar wall. The resultant structure, which is metal and thus highly conductive of heat energy, requires insulation in most localities in order to be useful through the entire year. However, because it is hemicylindrical in shape and composed entirely of metal, it is very difficult to insulate, and, without insulation, the building's types of uses and period of usage are reduced substantially.

There are four basic forms in which insulation material is commonly available: flexible rolls like fiberglass wool, rigid planar panels such as foamed polystyrene, foam-in-place polyurethane foam and loose flakes such as treated cellulose for blowing or pouring. The latter materials, the foam-in-place and the loose flakes and pellet forms, are obviously unsuitable for covering the interior surface of the arched buildings because there is nothing to hold the material in place. In some cases insulative material has been sprayed onto the interiors of metal arch buildings, but the material cannot be applied in a thick layer, particularly on the metal surfaces, without flaking away. Moreover, many of the sprayed materials are under attack for safety reasons.

Planar panels are unsatisfactory because they do not conform to the arched interior surface. Therefore, attachment in a continuous layer is exceedingly difficult. Moreover, even if means are provided for attaching the planar panels in an essentially continuous manner, the space between the arched surface and the planar panels is unavailable for use. Accordingly, the effective volume of the building is reduced substantially.

Thus, the only form of insulation material which is effective for the metal arch building is the flexible strip form usually available in rolls. However, the difficulty which has arisen is to provide means for securing the flexible, elongated strips of material to the interior surface of the walls. The task of attachment has not been a simple one because the major wall of the building is curved and metallic. When roll insulation is installed in conventional buildings, there are two primary means for securing the insulation in place. For insulating wood frame structures, particularly the roofs and outer walls thereof, insulation strips are inserted between rafters or studs and longitudinal flaps are stapled or nailed to the wooden rafters or studs. Additionally, a rigid planar layer such as plywood or sheet rock is often applied over the rafters or studs, enclosing the insulative strips. Occasionally the strips are neither stapled nor nailed. The strips are merely laid in position and only the covering layers secure the insulative strips in position.

However, in a metal arch building, there are no wooden rafters or studs into which staples or nails can be driven, nor is it economically feasible to apply a rigid layer over the insulative strips to maintain their position. Rigid, planar panels are not adaptable to the arched surface and, as noted above, there are no rafters or studs for attaching panels.

In accordance with the present invention, there is provided a method and apparatus for providing an insulative layer to the interior surface of an arched building. Briefly stated, a flexible layer of insulative material, preferably in strip form, is sequentially applied over the interior surface of the walls. A plurality of the coplanar shaft members that project inwardly from the interior surface of the building are caused to pierce the insulative layer. A flexible, elongated fastener member is overlaid on the exposed surface of the insulative strips. This strap member is provided with spaced apart perforations along its length, selected ones of which are brought into register with projecting shaft members, whereupon the shaft members are forced into the perforations to secure the strap member in position to thereby hold the insulative layer in position.

It is an object of the present invention to provide a method and apparatus for securing a flexible, insulative layer to a wall. It is also an object to provide a method and apparatus for applying an insulative layer to an arched wall. It is an additional object to provide means for applying insulation to the interior surfaces of an existing metal arch building using a minimum amount of additional material. Further objects and advantages will be apparent when the following description is considered in connection with the drawings in which.

Figure 1:
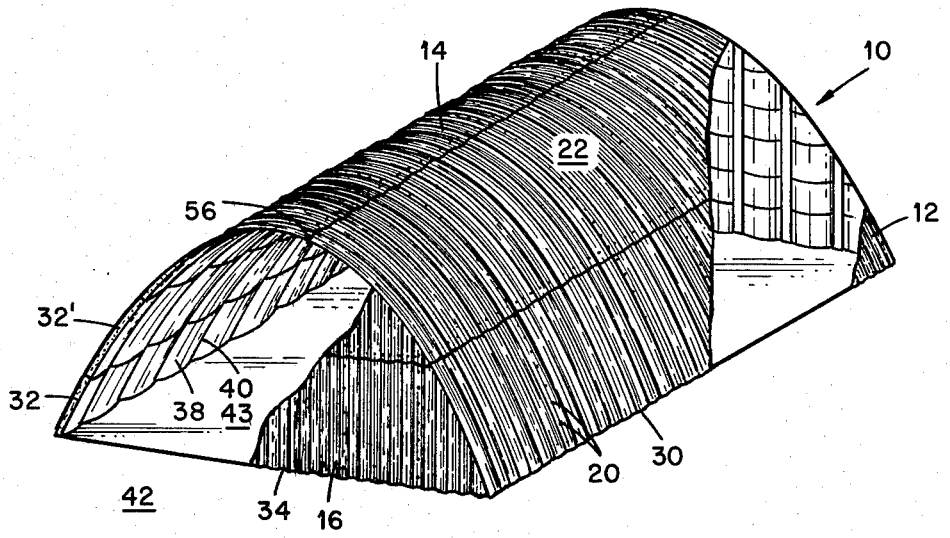
FIG. 1 is a partially broken-away perspective view of a building embodying various of the features of the present invention.

Referring to the drawings, a conventional metal arch building 10 is constructed from a plurality of corrugated steel panels 12. The building 10, comprising an arch wall 14 and a pair of opposing, planar end walls 16, defines a hemi-cylindrical shape. The end walls 16 enclose the building and a suitable door (not shown) is provided in at least one of the end walls 16 to provide access to the interior of the building 10.

The generally rectangular panels 12, each of which has a peripheral edge 18, are arranged in an overlapping pattern, i.e., the peripheral edge 18 of each panel extends either under or over the peripheral edges 18 of the adjacently surrounding panels 12. The corrugations provide a mating overlap of adjacent panels 12. Each panel 12 is joined to adjacent panels 12 by means of bolts 20 extending from the exterior surface 22 to the interior surface 24 of the building 10. That is, the bolt heads 26 are located on the exterior surface 22 of the building 10 and each bolt shaft 28 extends through two overlapped adjacent panels 12 to project inwardly from the interior surface 24 by a substantial distance, usually not less than about 0.5 inch. The bolts 20 are spaced apart on 6.5 inch centers.

In the depicted embodiment, the bolts 20 are about 1.5 inch in length and the bolt shafts are about 5/16 inch in diameter. The bolts 20 in the arch wall 14 are arranged in arcs extending between the base edges 30 of the arch wall 14. The bolts 20 in the end walls 16 are linearly arranged in rows. The panels 12 are about two feet wide. Thus, the bolt shafts 28 extend from the end walls 16 and the arch wall 14 in coplanar patterns at regular intervals of about two feet.

In accordance with the present invention, a first strip 32 of flexible, insulative material, such as fiberglass wool, for example, is laid against the end wall 16 along the lower edge 34. The strip 32, which includes a vapor barrier layer 36 comprising aluminum foil on kraft paper, is oriented on the end wall 16 such that the vapor barrier layer 36 is located on the interior side of the strip 32. In the depicted embodiment, the strip 32 is about four feet wide and extends across the full width of the end wall 16.

A plurality of the bolt shafts 28 in each row underlying the strip 32 are forced through the strip 32 by pressing upon the layer 36 immediately adjacent to each of the shafts 28. The rigid bolt shafts 28 puncture the strip 32, including the layer 36, to protrude from the interior surfaces 38 of the strip 32.

The insulation strips 32 are not self-supporting nor will they retain their position against the interior surface of the wall 14, even when impaled upon the bolt shafts 28. The present inventor has found that support for the insulation strip is readily supplied by means of an elongated flexible fastener straps 40 that are stratigically located with respect to the insulation strips. Specifically, the fastener strap 40 comprises a flexible polyvinyl-chloride plastic material. The strap 40 is about 1.25 inches wide, about 0.04 inch thick, and preferably about 6 feet long for ease of handling. Other lengths are suitable, however.

A plurality of elongated apertures or slots 44 are defined in the straps 40, spaced apart on 6.25 inch centers like the spacing between the bolts 20. Each aperture 44 is about 0.25 inch wide and about 0.75 inch long. The apertures 44 are oriented in a colinear pattern along the length of the strap 40. That is, the major dimension of the slots 44 are parallel to the length of the strap 40 to allow for slight variations in spacing between bolts.

Figure 3:
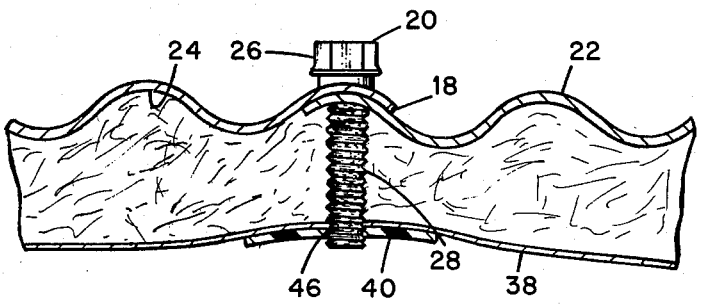
FIG. 3 is a cross sectional view taken along line 3—3 of FIG. 2.
Figure 2:
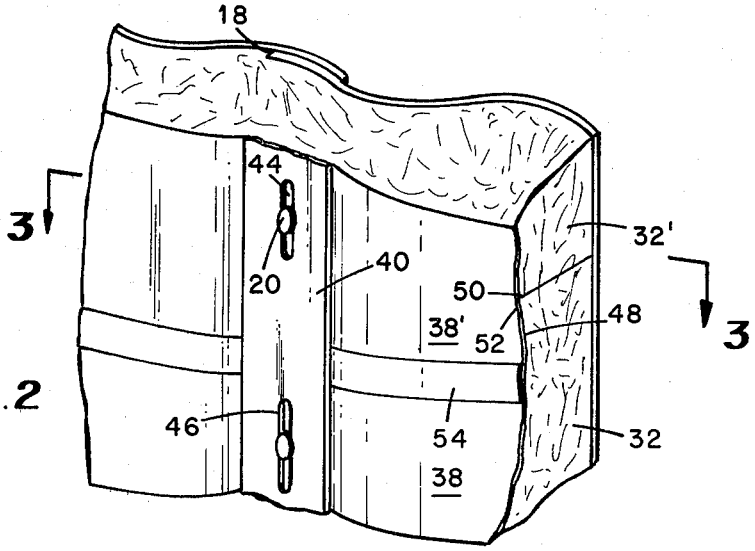
FIG. 2 is a fragmentary perspective view of a system embodying various of the features of the present invention.

The threaded bolt shafts 28 have a diameter slightly greater than the width of the apertures 44 so that the shafts 28 do not easily slide through the apertures 44. However, the combination of the elongated shape of the aperture 44 and the flexibility of the strap 40 permits an installer to force the bolt shafts 28 through the apertures 44. As the strap is forced onto a bolt shaft 28, the peripheral edge 46 of the aperture 44 trails the rest of the strap 40 because of the frictional engagement of the edge 46 with the threaded bolt shaft 28. Thus, when the installer ceases to apply pressure to the strap 40 the edge 46 adjacent to the shaft 28 remains slightly flexed, as shown in FIG. 3. The combination of the slight flexing and the rough surface of the threaded bolt shaft 28 causes the fastener strap 40 to apply a strong grip upon the shaft 28 and to substantially resist removal of the strap from the shaft. The strap 40 is similarly secured to each of the shafts 28 of a row of aligned bolt shafts 28 which extend through the insulation strip 32.

In accordance with the present method, preferably, insulation is first applied to the end walls 16 of the building. To this end, a first strip of insulation is positioned along the bottom edges 30 of and in face-to-face contact with the wall, the length of the insulation strip being oriented horizontally, i.e., parallel to the floor 43 of the building. Thereupon, one end of a strap 40 is secured to the bottom shaft 28*a*, thence to the shafts 28*b* and 28*c*. This leaves about 4 feet of strap length free and this free end is allowed to fall away from the wall 16 and hang free. Like additional straps 40 are secured to bolts shafts in the other rows fo the shafts 28 to thereby secure the insulation strip in place against the wall along the length of the insulation strip.

Thereafter a second strip 32', also about four feet wide, is applied to the end wall 16 above the first strip 32 in the same manner that the first strip 32 was applied. The second strip 32' includes a four inch wide flap 48 along the lower edge 50. The strip 32' is located immediately above the first strip 32 such that the flap 48 along the lower edge 50 of the second strip 32' overlays the upper edge 52 of the first strip 32. The bolt shafts 28 are forced through the strip 32', including the layer 38'. The flap 48 is attached to the first strip 32 by means of a length of adhesive tape 54, for example. The flap 48 serves to prevent air from passing between the strips 32 and 32'. Thereafter, the portion of the straps 40 which were flopped back toward the ground 40 are then lifted and forced over the bolt shafts 28 puncturing the second strip 32', thus securing the second strip 32' in position.

Depending upon the height of the end wall 16, succeeding strips like 32 and 32' are applied to the end wall 16 until the wall is entirely covered. The straps 40 extend vertically from the ground 42 to the intersection of the end wall 16 with the arch wall 14, where they are cut off.

After both end walls 16 are covered with insulative strips 32 to provide an essentially continuous layer, the arch wall 14 is covered, starting with a lower edge 30. As with the end wall 16, a first strip 32 of insulative material is laid against the arch wall 14 its the lower edge 30. The underlying bolt shafts 28 are forced through the strip 32 to project therefrom inwardly of the building. A strap 40, having a length sufficient to extend from the edge 30 to the peak 56 of the building 10, following the contour of the building, is attached to the bolt shafts 28 securing the first strip 32 to the wall 14. Thereafter a second strip 32' is similarly secured to the wall 14. As in the end wall 16, the second strip 32' and each successive strip includes a longitudinally extending flap 48 which overlaps the subjacent strip. An adhesive tape strip 54 is applied along the length of the flap 48 to secure the flap to the overlapped subjacent strip 32.

When the wall 14 is covered with a secured insulative layer from the edge 30 to the peak 56, the installer begins with a new first strip 32 along the opposing edge 30 of the arch wall 14 and secures insulative strips 32 upwardly to the peak 56.

The flexible nature of the straps 40 allows the straps 40 to flop back toward the ground so that they do not obstruct the installation of the successive strips of insulative material. However, after the first strip is applied, all of the fastening materials are immediately accessible to the installer. The bolt shafts 28 are already fully secured in the desired location. The straps 40 are flopped back, directly below the desired point of attachment. There are no loose parts to be lost.

The insulative layer which is applied to the arch building has an exceedingly small number of seams, which provide the largest opportunities for heat transfer. Moreover, the attaching system is adaptable to a wide variety of thicknesses of the insulative layer. That is, the same system is usable for a flexible strip which is one inch thick as well as for a strip which is four inches thick. The installer merely compresses the strip around the shafts. Also, the same system is usable regardless of whether the strips are one foot wide or four feet wide. Although additional adhesive tape may be required for narrower strips, no additional straps are required nor must additional bolt shafts be inserted.

The system is suitable for presently existing buildings. No additional holes are required by the system. The system may be applied at the time of initial construction or at any time thereafter.

While a preferred embodiment has been shown and described herein, it will be understood that there is no intention to limit the invention by the disclosure, but rather, it is intended to cover all modifications and alternate constructions falling within the spirit and scope of the invention as defined in the appended claims.

What is claimed:

1. In an insulated building including a wall having an interior surface, a flexible layer of insulative material covering said interior surface and a plurality of aligned shaft members projecting inwardly from said interior surface through said insulative layer, the improvement comprising means for securing said flexible layer to said wall, said securing means comprising an elongated fastener member comprising a flexible material defining elongated slot means adapted to frictionally engage a plurality of said shaft members.

2. An apparatus as defined in claim 1 wherein the major dimension of said elongated slot means is oriented substantially parallel to the length of said elongated fastener member.

3. An apparatus as defined in claim 1 wherein said elongated slot has a major dimension which is at least twice as great as the minor dimension of said slot.

4. Means for securing a flexible, insulative layer to a wall having an exterior surface and an interior surface and including a plurality of aligned shaft members projecting inwardly from said interior surface through said insulative layer, said securing means comprising an elongated flexible strap member defining elongated slot means adapted to frictionally engage a plurality of said shaft members interiorly of said insulative layer.

5. Securing means as defined in claim 4 wherein said shaft members comprise bolts extending through said wall from said exterior surface.

6. Securing means as defined in claim 4 wherein said insulative layer comprises a plurality of horizontally aligned insulative strips.

7. Securing means as defined in claim 6 wherein each of said strips includes overlapping flap means along a horizontal edge.

8. A system for insulating a building wall having an interior surface, said system comprising a plurality of aligned shaft members projecting inwardly of said building from said interior surface, a layer of flexible insulative material covering said interior surface, said shaft members extending through said insulative layer, and an elongated fastener member comprising a flexible material and including elongated slot means adapted to frictionally engage a plurality of said aligned shaft members, whereby said insulative layer extends between said interior surface and said fastener member.

9. A method of insulating a building wall having an interior surface and including a plurality of aligned shaft members extending inwardly from said interior surface comprising, (a) applying a layer of flexible insulative material to said interior surface, (b) directing a plurality of said shaft members through said insulative material to project inwardly of said building from said layer, (c) engaging a plurality of said inwardly extending shaft members with elongated slots defined in flexible elongated strap means, thereby securing said layer between said interior surface and said strap means.

* * * * *